US006155603A

United States Patent [19]

Fox

[11] Patent Number: 6,155,603

[45] Date of Patent: Dec. 5, 2000

[54] LABORATORY REPORTING SYSTEM AND LABELING SYSTEM THEREFOR

[76] Inventor: Joshua L. Fox, 51 Herrick Dr., Lawrence, N.Y. 11559

[21] Appl. No.: 09/133,525

[22] Filed: Aug. 13, 1998

[51] Int. Cl.[7] ..... B42F 21/02; B42D 1/10; B42D 15/00

[52] U.S. Cl. ..... 283/62; 283/66.1; 283/48.1; 283/115; 283/900

[58] Field of Search ..... 283/66.1, 48.1, 283/115, 62, 900

[56] References Cited

U.S. PATENT DOCUMENTS

| | | | |
|---|---|---|---|
| 3,226,862 | 1/1966 | Gabruk | 40/2 |
| 4,669,754 | 6/1987 | Lalonde | 283/67 |
| 5,142,384 | 8/1992 | Wood et al. | 206/457 |
| 5,636,873 | 6/1997 | Sonsteby | 283/81 |

*Primary Examiner*—A. L. Wellington
*Assistant Examiner*—Mark T. Henderson
*Attorney, Agent, or Firm*—Davidson, Davidson & Kappel, LLC; Morey B. Wildes, Esq.

[57] ABSTRACT

A labeling system for pathology reports which is useful to adhere the prepared report directly to the patient's chart without the need for transcription. The system of the invention incorporates means for ease of recognition of problem diagnosis, graphics of the biopsy anatomical site which includes colorization that allows easy identification of diagnosis and the area to be treated. The system of the invention also provides for an indication of recommended follow-up treatment, non-treatment or close follow-up as may be appropriate. This system includes an overlay system and a system to follow suspicious lesions with or without their physical relationship to previously biopsied sites.

45 Claims, 12 Drawing Sheets

XYZ LABORATORIES
789 CROSS STREET
NEW YORK NY 10011
(212) 987-6534

OBTAINED
RECEIVED 06/09/98
REPORTED: 06/10/98
ACCESSION# 5138-1998

DERMATOPATHOLOGY REPORT

PATIENT: SAMPLE SAMPLE
AGE: 78 DOB: 02/19/20
SEX: FEMALE RACE:
ACCT# 1978 SS# 123456789

ABC DERMATOLOGY ASSOC.
PHYSICIAN: JANE SMITH
123 MAIN STREET
NEW YORK NY 10001

DIAGNOSIS A OF A
SQUAMOUS CELL CARCINOMA,
SUPERFICIAL TYPE

NOTE: THE LESION EXTENDS TO
THE MARGIN OF THE BIOPSY.

SPECIMEN SITE: LEFT CHEEK

COLOR KEY
- CANCER
- PRECANCER/ ATYPICAL
- BENIGN
- INFECTIOUS
- INFLAMMATORY

R L

323

322

FOLLOWUP: GENERALLY REQUIRES TREATMENT

CLINICAL DATA: BCC
PROCEDURE: EXCISION
CLIENT COMMENT:

GROSS DESCRIPTION:
FIXATIVE: 10% FORMALIN SIZE: 02x02x04
COLOR OF TISSUE: TAN # OF BLOCKS: 1
SHAPE: FLAT PIECES:1

300

321

PHOTOMICROGRAPH / MICROSCOPIC DESCRIPTION:

THERE ARE IRREGULAR MASSES OF ATYPICAL KERATINOCYTES EXTENDING FROM THE EPIDERMIS INTO THE SUPERFICIAL DERMIS.

R L

OVERLAY DIAGRAM GROSSING DIAGRAM

320

GEORGE W. MEETT, M.D. LAB DIRECTOR

301

CLINICAL PHOTOGRAPH

302

302

PT: SAMPLE SAMPLE 1234567890 06/09/98
SITE: LEFT CHEEK BCC
DIAGNOSIS: SQUAMOUS CELL CARCINOMA, SUPERFICIAL TYPE
NOTES: THE LESION EXTEND TO THE MARGIN OF THE BIOPSY. GENERALLY REQUIRES TREATMENT

330

PT: SAMPLE SAMPLE 1234567890 06/09/98
SITE: LEFT CHEEK BCC
DIAGNOSIS: SQUAMOUS CELL CARCINOMA, SUPERFICIAL TYPE
NOTES: THE LESION EXTEND TO THE MARGIN OF THE BIOPSY. GENERALLY REQUIRES TREATMENT

R L

SAMPLE SAMPLE
06/09/98 5138-1998

331

SAMPLE SAMPLE
123 MAIN ST
ANY TOWN NY 11111

313

332

304

FIG. 3

| DATE | PATIENT NAME | DR | INS & LAB | M.A. SIGN | SITE | CLINICAL IMPRESSION | BIOPSY RESULTS | TX |
|---|---|---|---|---|---|---|---|---|
| | | | | | | | PT: SAMPLE SAMPLE 1234567890 06/09/98<br>SITE: LEFT CHEEK BCC<br>DIAGNOSIS: SQUAMOUS CELL CARCINOMA, SUPERFICIAL TYPE<br>NOTES: THE LESION EXTEND TO THE MARGIN OF THE BIOPSY. GENERALLY REQUIRES TREATMENT | |
| | | | | | | | | |
| | | | | | | | | |
| | | | | | | | | |
| | | | | | | | | |

330

FIG. 5

TODAY'S DATE _____ PATIENT'S NAME _____

ADDRESS _____ INSURANCE _____

TEL. NO. ____ REFERRED BY ____ OCCUPATION _____ AGE ___ SEX M F

| DATE/VISIT # | PROGRESS NOTES | MEDS./TREATMENT |
|---|---|---|
| | PT: SAMPLE SAMPLE 1234567890 06/09/98<br>SITE: LEFT CHEEK BCC<br>DIAGNOSIS: SQUAMOUS CELL CARCINOMA, SUPERFICIAL TYPE<br>NOTES: THE LESION EXTEND TO THE MARGIN OF THE BIOPSY. GENERALLY REQUIRES TREATMENT<br>330 | R L<br>SAMPLE 06/09/98 SAMPLE 5138-1998<br>331 |

FIG. 6

PATIENT SUMMARY CHART

PATIENT'S NAME _____

ADDRESS _____ INSURANCE _____

TEL. NO. ____ REFERRED BY ____ OCCUPATION _____ AGE ___ SEX M F

PT: SAMPLE SAMPLE 1234567890 06/09/98
SITE: LEFT CHEEK BCC
DIAGNOSIS: SQUAMOUS CELL CARCINOMA, SUPERFICIAL TYPE
NOTES: THE LESION EXTEND TO THE MARGIN OF THE BIOPSY. GENERALLY REQUIRES TREATMENT

330

331

PAGE NO.___

XYZ LABORATORIES
789 CROSS STREET
NEW YORK, NY 10011
(212) 987-6543

DERMATOPATHOLOGY
TISSUE PROCESSING
REQUEST FORM

DUPLICATE REORT TO: _____

COMMENTS TO PRINT OUT ON REPORT: _____

SPECIAL INSTRUCTIONS: REFERRAL #
CHECK MARGINS ☐ FAX RESULTS ☐
RUSH ☐ CONSULTATION ☐
CALL MD W/RESULTS ☐ OTHER ☐ _____

BIOPSY METHOD: ☐PUNCH ☐EXCISION ☐INCISIONAL ☐SHAVE ☐CURRETTE ☐SNIP ☐SAUCERIZATION ☐LASER

| BIOPSY SITE | DURATION | HISTORY/ DESCRIBE | CLINICAL DIAGNOSIS |
|---|---|---|---|
| A | | | |
| B | | | |
| C | | | |
| D | | | |
| E | | | |

ADDITIONAL INFORMATION _____

I AUTHORIZE THE RELEASE TO MY INSURANCE CARRIER OF ANY MEDICAL INFORMATION NECESSARY TO PROCESS THIS CLAIM, AND I AUTHORIZE PAYMENT OF MEDICAL BENEFITS DIRECTLY TO XYZ LAB.

SIGNATURE DATE:

PATIENT INFORMATION RACE (OPTIONAL)
M ☐ F ☐
SS# DATE OF BIRTH
LAST NAME FIRST NAME M.I.
STREET ADDRESS
CITY STATE ZIP
TEL.# CHART # PATH #

PATIENT'S PRIMARY INSURANCE BILL TO MC ☐ BILL TO PT ☐
INSURED'S NAME D.O.B.
PT RELATIONSHIP TO INSURED: SELF ☐ SPOUSE ☐ CHILD ☐ OTHER ☐
POLICY # / SS # _____
GROUP NANE / # _____
NAME OF UNSURANCE CO. _____
INSURANCE ADDRESS* _____
CITY _____ STATE ____ ZIP _____

SECONDARY INSURANCE
INSURED'S NAME D.O.B.
PT RELATIONSHIP TO INSURED: SELF ☐ SPOUSE ☐ CHILD ☐ OTHER ☐
POLICY # / SS # _____
GROUP NANE / # _____
NAME OF UNSURANCE CO. _____
INSURANCE ADDRESS* _____
CITY _____ STATE ____ ZIP _____

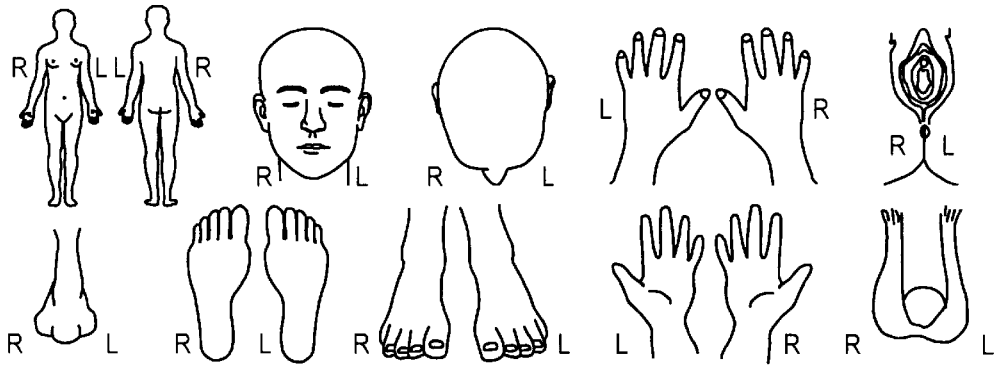

FIG. 8

COLOR KEY
(RED) - CANCER - Δ
(PINK) - PRECANCER/ATYPICAL
(GRAY) - BENIGN
(GREEN) - INFECTIOUS
(BLUE) - INFLAMMATORY
FIG. 11
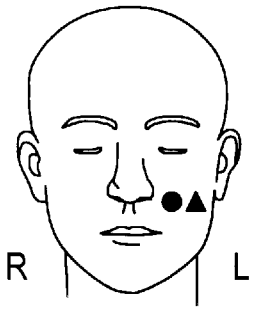
FIG. 12A
● SAMPLE 06/09/98 SCC
▲ SAMPLE 05/13/98 BCC
SPECIMEN SITE: LEFT CHEEK
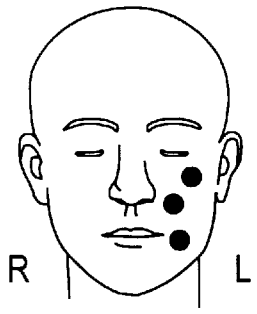
FIG. 12B
EX - 6/1 - 12/31/1998
EX - ONLY BASAL CELL CARCINOMA

LABORATORY REPORTING SYSTEM AND LABELING SYSTEM THEREFOR

BACKGROUND OF THE INVENTION

The present invention relates generally to a system for reporting the results of pathology laboratory tests. More particularly, the present invention relates to a pathology report system including labels containing diagrams, anatomical site, photomicrographs, photographs and summarized reports that may be adhered to the patient's chart.

Presently in the United States, virtually all pathology service companies provide a general pathology or dermatopathology report, along with their pathology laboratory services, that normally includes the name, address, telephone and fax number of the pathology service company. The pathology report also includes other information such as the patient's name, date of birth, sex, race, file number, physician's (client) number, location of biopsy, pathology number, and the dates that the biopsy was obtained, received and reported. In addition, this report includes clinical data provided by the provider concerning the impression, specimen site, gross description, the microscopic description and the diagnosis, as well as the provider's signature. This information is contained in essentially all pathology reports, whether specialized for dermatopathology, general pathology or other fields of pathology.

It is a standard practice of physicians to enter the information on the pathology reports directly into the patient's chart, either by themselves or, more often, by having their staff copy the diagnoses and notes (comments) by hand from the pathology report into the chart, initialing the entries and writing the date received. Several errors can occur during this process. For example, the diagnosis may be incorrectly transcribed into the chart, such as by miswriting squamous epithelium as squamous cancer or other serious cancers. Or, the information may be incompletely transcribed into the chart, such as by omitting from the report a comment (note) that states that the margins of the body area are clear and completely excised. In addition, the biopsy information may be copied into the wrong chart. Each of these errors can easily lead to disastrous results, such as unnecessary surgery and perhaps even malpractice suits. Unfortunately, there exist few double checks in the commonly utilized procedures.

Another common practice that causes errors is when a doctor merely notes on the file "pathology report received" and then places the pathology report in the chart. The problem with this approach is that the physician may later be unable to figure out the results of all the previous biopsies performed, especially for patients having thick charts or multiple biopsies. The only biopsy whose results are easily determined in such a case is the biopsy reviewed on the most recent biopsy report. This has often led to confusion in diagnoses and in treatment of lesions, especially when a chart is filled with multiple biopsies and reports that deal several different skin cancers and pre-cancers, as commonly occurs in the field of dermatology. Moreover, the time expended reviewing pathology reports for all previous visits is extremely wasteful. As a result, some doctors forgo reviewing the reports and instead rely on their memories, especially since as managed care has forced some physicians to shorten the time of the office visits. Until now, there has been no way for a diagnosis and other pertinent information to be entered into the patient's specific clinical chart and biopsy books as well as into any summary reports in order to facilitate rapid review of the chart without writing these out by hand and risking the errors described above.

Another common practice is for many doctors to maintain biopsy books in which they write the name and other pertinent information regarding the patient and in which some doctors note whether or not the patient needs to be treated. The "treatment performed" section serves as a check on whether or not the lesion was treated appropriately. However, several errors can result in this instance, as well. First, many doctors do not have biopsy books and, even if they do, do not note whether the biopsy requires treatment. In addition, if a biopsy is not written or is incorrectly written into the biopsy book, there would be no check on the system. Also, if a medical assistant or nurse mistakenly checks "no treatment needed" in the chart, due either to difficulty in reading the doctor's handwriting or a lack of understanding of the diagnosis, there is no cross check in the system since the same nurse generally handles all aspects of the pathology report. There also exists the possibility of someone writing the biopsy report in the wrong place or of someone with poor handwriting preparing notes, thereby allowing other staff to skip over it, etc. In addition staff members may forget to enter notations into the book. Because there is no appropriate check on the system, all these potential failures may lead to additional problems with obtaining appropriate treatment for the specific pathological diagnosis, with almost disastrous results. Biopsy books are, therefore, another area of the clinical record in which a new system would be helpful to increase accuracy and tracking, to save time and money, and to decrease errors and potential lawsuits.

Historically, there has been no easy way to follow up on biopsies entered in the patient chart, even though follow up can be particularly important with a patient who has had multiple biopsies performed on different dates, often in similar areas. Until now, a physician noted on the pathology report only whether or not the patient needed treatment. There is no system that illustrates the specific area treated and that also produces a charting system that can be entered directly into the patient's chart. Presently, the required clinical follow-up falls primarily on the shoulders of the physician with minimal backup from the responsible support staff, or, alternatively, primarily on the support staff, especially with minimal input from the physician. This situation has often led to difficulty in treatment or to improper treatment. There has not been a good follow-up system developed that would blend the two so that the clinician is specifically responsible and actively monitors this function. In particular, a follow-up should be organized, once the physician has had input during the set-up stage, through the use of specialized software in a simple way such that the physician's staff will know automatically from the color-coded label and pathology report which diagnoses require what type of follow-up. This will allow the report to be followed in the chart and allow patients to be called automatically with the appropriate message, so that other follow-up steps can be taken if required. This procedure eliminates duplicate work and improves patient care, delivery and thus saves both time and money, while delivering a better quality of care. A detailed follow-up system to allow the support staff to give the patient the appropriate and more detailed information and reassurance required has not been available in a simple automatic manner.

Pathology reports have historically lacked accurate diagrams detailing the area of the body that has been biopsied. In addition, standard pathology requisition forms and reports do not specify the exact or even the general area to be treated, often leading to improper treatment or inappropriate tracking of the disease. Without a diagram, an area that a clinician refers to on the pathology requisition form as, for example, the right shoulder may actually be a part of the back, clavicle chest or upper arm. In addition, the patient may have several lesions in the same area, further compounding the problem. It is desirable to provide a pathology requisition form that identifies precisely the location of the biopsy to be performed.

There is no system that transfers the exact location or quadrant where the biopsy is done, known as the anatomic site of biopsy, from the requisition slip onto a reporting system so that it can be entered in the chart, the biopsy book, the patient's summary report and the pathology report. Therefore, it is also desirable to provide a pathology report and labeling system that mimics the requisition form clearly identifying the location of the biopsy sample on the drawing.

Moreover, there is currently no system available that produces any of these entries via labeling system. In addition, even if an existing pathology reporting system were to have a label diagram, there is presently none that could summarize multiple biopsies, namely a history of the patient's biopsy's over time, into one picture of a specific anatomic site. A feature that could summarize into one location or drawing results of all previous biopsies is crucial for the physician, who must know all previous sites of cancer, for example, when examining the patient during a checkup so as to enable him to study those areas more carefully and more rapidly.

Typically, almost all presently available pathology reports are printed in black and white ink. This does not allow for easy recognition of problem areas and does not allow one to highlight specific problems using color-coding, which is more rapidly detected by staff to highlight potential problems. Also, currently available pathology reports are uniform, irrespective of the clinician's personal desires or requirements. A pathology reporting system and pathology labeling system that is unique for each clinician's individual needs, based upon their particular preferences and treatment patterns, has not been developed and thus is not available in the art. A labeling system reflecting these improvements would, therefore, be helpful for the clinician and for their patients.

The applicants are aware of the following prior art references that are generally related to the present invention:

U.S. Pat. No. 5,636,873 (Sonsteby) discloses a patient documentation system using removable adhesive backed labels in a notepad form, each pad relating to a specific anatomical area and/or specific illness for adhesion into a patient's chart. The labels can have the form of checklist or steps for proper medical care and documentation or the form of anatomical diagrams onto which annotation can be made regarding the medical care rendered.

U.S. Pat. No. 4,865,549 (Sonsteby) discloses a medical documentation system using modularized color coded information packets relating to specific body systems, including peel-off labels, providing a series of diagnostic steps, for the temporary adhesion to the patient chart.

U.S. Pat. No. 5,048,870 (Mangini at al) discloses multipart flag labels with peel-off copies for use in pharmaceutical record keeping, inventory, billing, etc. Information is completed on one copy of a label and automatically transferred to other labels using carbon paper or the like such that more than one peel-off label bearing pre-printed and just entered data can be used.

U.S. Pat. No. 4,295,664 (Cutting) discloses a medication record keeping package for charting medications prescribed and administered to a patent. Information recorded on a cover sheet is duplicated on underlying, pressure sensitive, tear-off sheets that can be removed and affixed at a remote location.

U.S. Pat. No. 3,625,547 (Burke) discloses a multi part prescription form with separable labels for medication, prescription renewal and record keeping. The labels are pressure sensitive and superimposed so that entry of information on the top label also enters the information on a label underneath for adherence to another location.

U.S. Pat. No. 4,799,712 (Biava et al) discloses a physician's prescription form having pressure sensitive, peel-off labels for medication bottles and medical charts.

U.S. Pat. No. 5,484,170 (Hatfield, Jr.) discloses a unitary shipping label in the form of an adhesive label strip with multiple removable panels for use as shipping labels, product information labels, and packing slips.

U.S. Pat. No. 5,637,369 (Steward) discloses a business form including a card produced by adhering conventional label stock to the back of the form, cutting entirely through the business form and partially through the label stock to produce a removable label and a new card.

In view of the available prior art pathology reporting systems and the prior art medical documentation systems, it is clear that there is a need for a new system for easier charting, summarizing pathology reports, demonstrating diagrams and photographs, and photomicrographs allowing for a customized computer-generated report and customized clinical disease follow-up that is color-coded so as to allow for ease of treatment.

SUMMARY OF THE INVENTION

The present invention is directed to providing a clinician or hospital with pathology laboratory reports including a labeling system for pathology reports, which is useful in adhering sections of the prepared report directly to the patient's chart without the need for transcription. The reporting system of the invention incorporates means for ease of recognition of problem diagnoses and graphics of the biopsy anatomical site, which includes color coded categories that allow easy identification of diagnosis and the areas to be treated. The labeling system includes a clinical photograph and/or photomicrograph, digital histology photograph, a photograph of the patient's biopsy, and a superimposed overlay of the patient's previous biopsies, i.e., namely a diagram of biopsies at the same site over time.

The advantages of this labeling system include (a) rapid easy charting, (b) avoidance of errors in transcription or labeling the wrong chart,(c) recognition of problem diagnoses, (d) quicker facilitation of clinical follow-up, (e) highlighting and describing clinical follow-up so as to avoid failure to treat, (f) graphics of the biopsy anatomical site including colorization that allows easy identification of a diagnosis category and area to be treated, (g) identification of recommended follow-up areas, (h) easy labeling of specimen bottles and fungal cultures, (i) customization of the labeling system in order to allow variations specified by the clinician, by using the software program accompanying the system, i) better clinical follow-up to patient, staff, and/or referring doctor via personalized facsimile of pathology report and personalized educational letters and fact sheets, and (k) interactive reports and personalized reports that allow for client comment and personalized reports that can be changed via internet access.

It is, therefore, an object of the present invention to provide an improved system for reporting laboratory pathology results.

It is another object of the present invention to provide a clinician or hospital with a pathology report labeling system that includes a summary report to adhere to the patients chart.

It is a further object of the present invention to provide a clinician or hospital with a pathology report system that includes a graphic depiction of the biopsy area of the body with an accurate indication of the biopsy location, which depiction is color coded and shape coded to allow for rapid diagnosis and decrease in risk of error.

It is yet another object of the present invention to provide a clinician or hospital with a pathology report system that includes a color-coded indication of diagnosis.

It is still another object of the present invention to provide a clinician or hospital with a pathology report system that includes a recommended course of follow-up treatment.

It is still a further object of the present invention to provide a clinician or hospital with a pathology report that includes a series of removable labels, the format of which may be customized as to content, size and number to include whatever information the user desires, which labels may subsequently be applied to a patient's chart, a physician's biopsy book, a follow-up log or to other locations as may be deemed appropriate.

It is another object of the present invention to provide a pathology report system that would allow the clinician to choose and design certain parameters of his pathology report such as size of report, type style, comments etc.

It is a further object of the present invention to provide a pathology report labeling system that would allow for clinical photographs and/or photomicrographs to be placed on the report and on the labels for the pathology chart.

It is yet another object of the present invention to provide a clinician or hospital with a pathology report which has a superimposed overlay of the anatomic site diagnosis all in one diagram by site, which can be separated by diagnostic category, follow-up type diagnosis and other criteria.

It is still another object of the present invention to provide (1) an interactive program for preparing a personalized patient letter designed by the clinician with or without a clinical diagram, photograph, and/or photomicrograph, including all relevant biopsy information and follow up recommendations; (2) a personalized referring physician letter with or without clinical diagram, photograph, and/or photomicrographs containing all relevant biopsy information and follow up recommendations, but also including a duplicate pathology report with the referring physician's name noted, and (3) patient information fact sheets, regarding which the clinician decides what patient information is included on their education fact sheets on different diagnosis, wound care sheets, etc.

These and other objects of the invention will become apparent to one skilled in the art from the following more detailed disclosure of the invention.

BRIEF DESCRIPTION OF THE DRAWINGS

The above and other objects and advantages of the invention will be more apparent upon consideration of the following detailed description, taken in conjunction with the accompanying drawings, in which the same reference characters in different figures refer to the same or similar parts, and in which:

FIG. 3 shows a preferred embodiment of a typical pathology report sheet to be used for dermatology according to the invention;

FIG. 5 shows a typical use of one of the report labels of the invention on a page of a biopsy book;

FIG. 6 shows a typical page from a patient's chart into which two of the biopsy report labels have been adhered.;

FIG. 8 shows a diagram typical pathology requisition sheet for dermatology;

FIG. 11 shows an actual color coded diagram with shapes to depict category of diagnosis;

FIG. 12*a* shows a superimposed overlay with two dated samples shown;

FIG. 12*b* shows a superimposed overlay used to depict diagnoses over time;

DETAILED DESCRIPTION OF THE INVENTION

Figures 1, 2A, 2B, 2C, 2D:
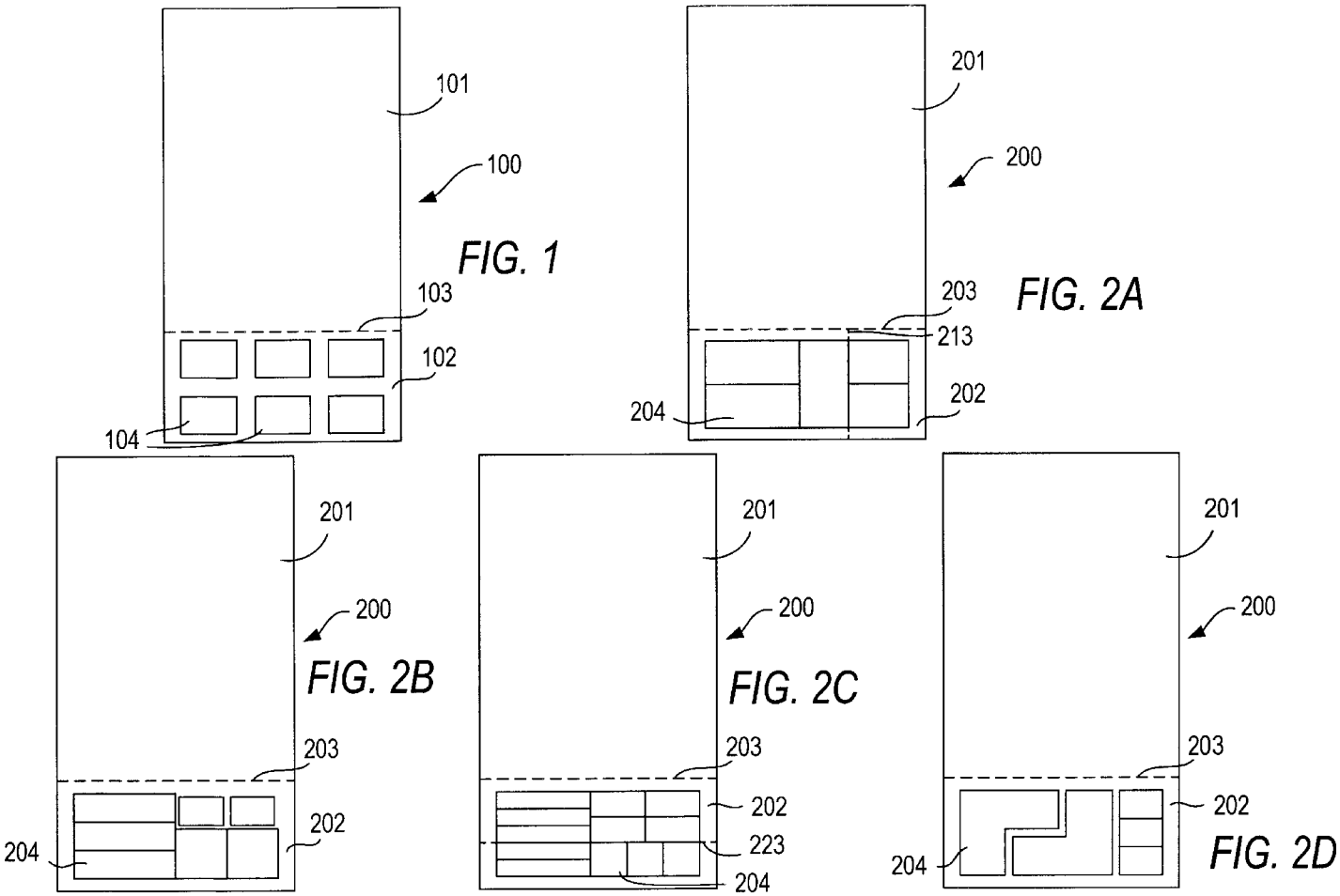
FIG. 1 shows a format of typical sheet of paper onto which the pathology report of the current invention is prepared.
FIGS. 2A, 2B, 2C and 2D show the sheet of FIG. 1 having different label patterns and sheet sizes.

Referring now to the drawings, FIG. 1 shows a sheet onto which the basic pathology report of the present invention is prepared. In a preferred embodiment of the invention, sheet 100 consists of a standard page, a portion of which is coated with label material. The top portion 101 of sheet 100 is normal paper for printing, and the bottom portion 102 of sheet 100, preferably approximately one-third or one-fourth thereof, is formed from adhesive material such that it is configured for multiple labels 104. Such material can typically have wax backing to allow for easy removal of labels 104. In addition, bottom portion 102 of sheet 100 is separable from top portion 101 by a tear line 103, such as a perforation or a score line, so that it can be easily removed from top portion 101 by tearing along tear line 103. Thus, once labels 104 have been peeled off, bottom portion 102 can be separated from top portion 101, leaving top portion 101 in the form of a standard 8½×11 sheet of paper 101, which will become the pathology report. Tear lines 103 other than perforations and score lines may be used. Likewise, labels 104 could be of the self-stick variety or of the type that must be wet in order to be adhered.

Since pathology findings to date never been placed on labels for application to other documents and files, printing the pathology report on a specially configured sheet of paper as shown in FIG. 1 is even more unique, less prone to error and provides more rapid filing and organization. The size of the portions of sheet 100 and the configurations of labels 104 can be altered to accommodate different sizes and numbers of labels according to the needs of the clinician, as shown in FIGS. 2A–C. FIGS. 2A and B show embodiments of pathology report sheets 200 whose top portion 201 in the standard 8½×11 U.S. paper size, and FIG. 2C shows an embodiment of the pathology report sheet 200 whose top portion 201 has a slightly smaller size. Of course, other embodiments could be shown having top portion 201 in larger size. Each of FIGS. 2A, 2B and 2C shows labels 204 with different sizes and in different configurations. In the preferred embodiment of the invention, the pathology report form will have several different size labels on the bottom portion of the sheet. It should be noted that FIGS. 1 and 2A–C show embodiments having only representative label configurations, which could also be customized in number, size and shape as desired by the clinician. FIG. 2D shows report sheet 200 on which labels 204 are configured in an L-shape such that one or more labels are "attached", such that more than one type of information or data can be provided on one label 204. Thus, the clinician would only have to apply one labels 204 to the client chart, rather than several as might be the case with FIGS. 2A–C.

In addition, sheets 200 may be equipped with tear lines in addition to tear line 203 that separates bottom portion 202 from top portion 201. Sheet 200 could also be configured to have tear lines, such as tear line 213 in FIG. 2A and tear line 223 in FIG. 2C, that cut across bottom portion 202 so as to allow only part of bottom portion 202 to be detached from top portion 201 once some of labels 204 have been removed. This will allow some of labels 204 to be left attached to the biopsy report (upper portion 201 of sheet 200) for later use, as described below.

A preferred embodiment of the pathology laboratory biopsy report sheet 300 for use in dermatology is shown in FIG. 3, and has a top portion 301 and a bottom portion 302. The main 8½×11 inch pathology report, i.e., the upper portion 301 of biopsy report 300, contains information such as the name, account number and location of the physician, the date the report was printed, the patient's name and personal data, the date of biopsy, the site of the biopsy, biopsy gross and microscopic descriptions. The main report 301 could also include special clinician or office information, patient comment, identifying features of the patient, and descriptions of the diagnosis and type of follow-up required. The pathology report form 301 also preferably includes an indication by either number or letter of the biopsies requisitioned and performed at that time in order to facilitate easy marking of the different bottles for this patient specimens. Thus, the reports could be labeled 1 of 2 and 2 of 2 (or A of B and B of B) in order to advise clinicians of the number of reports filed. Furthermore, report 301 could also include a clinical photograph 320, in the form of an actual picture, either two-dimensionally or three-dimensionally, of the biopsy site on the patient as well as a photomicrograph 321, also known as a digital histology photograph. A clinician can, of course, add additional information to the form as desired, as described below.

Figure 4:
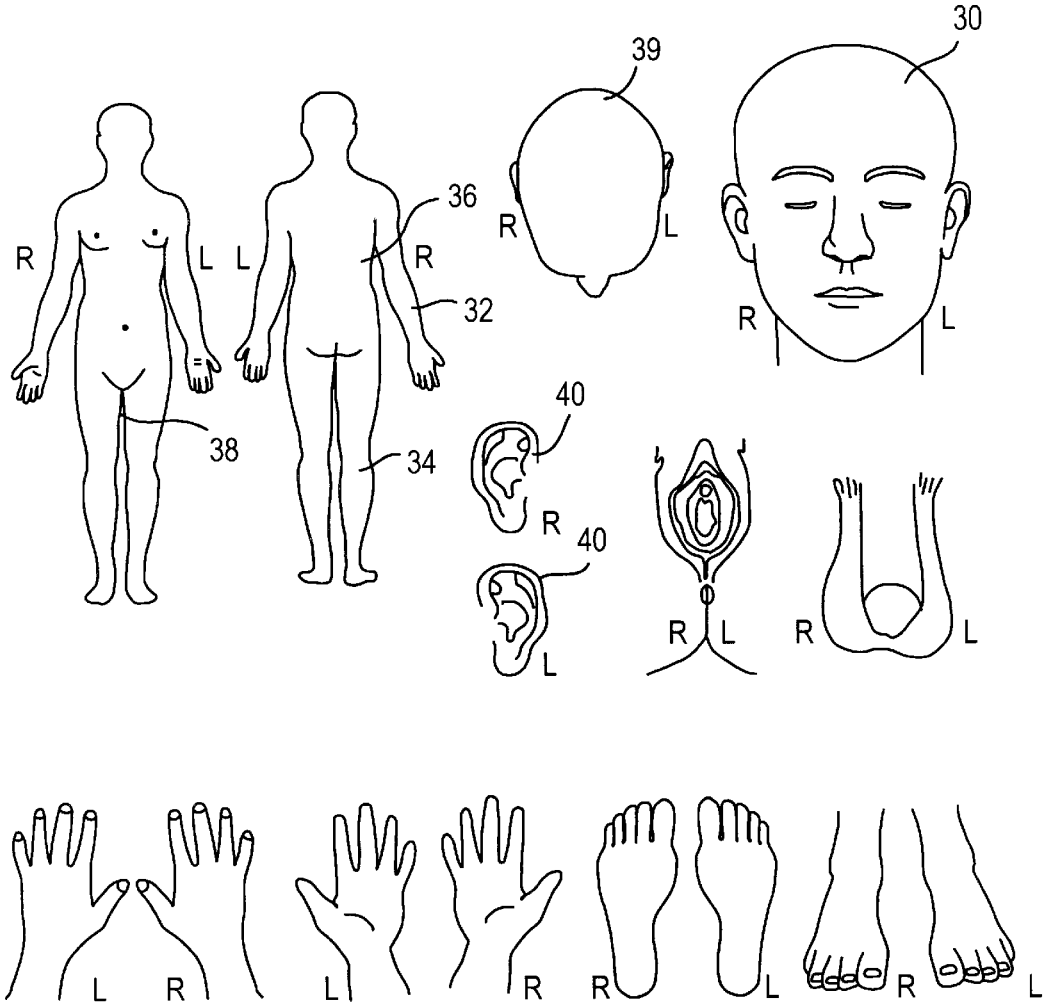
FIG. 4 shows diagrams of various body parts as such might appear on a typical pathology requisition form or a typical pathology report form for dermatology or podiatry.

The report form 301 may also have an anatomical diagram 322 showing the exact site of the biopsy in order to pinpoint the location more accurately than a mere description. Diagram 322 could be any one of various body parts, as shown in FIG. 4, depending on the area of specialty of the laboratory and the area biopsied. Drawings of any of these body parts, and of course others that are not shown here, might appear on a typical pathology requisition form that is used by a clinician for instructing the laboratory as to the exact site of the biopsy to be performed, such that the physician would indicate on the requisition form the site of the biopsy to be performed, and this diagram would be reproduced on the biopsy report. Biopsy report 301 shown in FIG. 3 is easily adapted for different fields of medicine by using different anatomical diagrams. Various options for this diagram are discussed below. However, should the clinician desire a pathology report without a diagram, one can also be provided.

A preferred embodiment of the pathology laboratory biopsy report sheet 300 shown in FIG. 3 also has bottom portion 302, which may be detached from top portion 301 along tear line 303, as described above with reference to FIGS. 1 and 2A–C. Bottom portion 302, as discussed above, has several labels 304. In a most preferred embodiment, bottom portion 302 of report form 300 has two labels 330 having summary biopsy reports pre-printed thereon. Each of labels 330 typically measures anywhere from a little less than 3 cm to about 4 or 5 cm in height by about 9 cm or more in width. The typical biopsy report label 330 includes key information from the biopsy report 301 that is required by the clinician but omits information that is not essential for the patient's chart. Report label 330 will typically include the patient's name, home and/or work telephone numbers, the date the biopsy specimen was obtained, accessioning number, specimen number, slide number, anatomical site where the specimen was obtained, the specific pathological diagnosis and any specific notes the pathologist made, as well as the clinical recommended follow-up treatment category. All this information is, of course, already included in the main pathology laboratory report 301. If the clinician requires additional or less information, such can also be provided.

In a most preferred embodiment, bottom portion 302 of report form 300 also has additional labels thereon, in different shapes and sizes in order to accommodate whatever information or purpose is desired by the clinician. For example, as shown in FIG. 3, bottom portion 302 could have label 331 showing an anatomical diagram of the precise site of the biopsy, similar to or exactly as the anatomical diagram 322 shown on the main biopsy report 301. Additionally, labels 332 could be prepared in specific size for use with medicine bottles so that the clinician who prescribed medicine for the biopsied patient will have medicine bottle labels readily available for use. The combination of labels 304 for specimens together with a pathology report 301 encompassing specific chart and patient information pre-completed out using customized computer software permits the system of the invention to generate a variety of different labels, with information desired by the clinician.

The label configurations can be organized to create biopsy labels for future biopsies or other tests including cultures and sensitivities, fungal tissues, etc. These labels may be used at later dates for fungal cultures, bacterial strains, cultured sensitivities etc. to speed office protocol and decrease the likelihood that the specimen may go unlabeled or improperly labeled. Additional labels are available for the patient's letter, a referring doctor's letter, a chart or other notations. Thus, bottom portion 302 of sheet 300 is provided with additional tear lines, such as tear line 313, so that the labels that are not used at that particular time can be left attached to top portion 301 and easily attached to pathology report 301. There is no need for paper clips, staples or removable stick-to notes using the system of the present invention.

In most patient charts, the pathology report is in a different section of the chart than the written record and, hence, for each biopsy the physician must constantly flip back and forth between the written record and the pathology report, including a diagram, thereby creating the risk of serious error in matching up the correct diagnoses to the appropriate reports. Sometimes it is impossible to clearly access the necessary information due to stapling or sticking together of reports, etc. This aspect is particularly important when multiple biopsies have been performed on different dates of service, often in the same areas of the patient's body.

Figure 7:
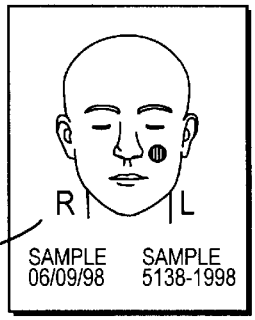
FIG. 7 shows a typical patient summary sheet onto which two of the report labels of the invention have been adhered.

The summary report labels 330, which are adhered directly to the patient's chart, for example, as shown in FIGS. 6 and 7, or a biopsy book, as shown in FIG. 5, allows for easier reading of the biopsy report. Also, when there are multiple biopsies, it is often difficult to determine which biopsy corresponds to which date of service and to which specific diagnosis. Hence, there is coupled to the summary report label 330 a diagram 331, with which one attaches the pathology label. This feature eliminates the possibility of mixing up the biopsy report on the label 300. Also, unique to the pathology report labels 330 and 331 system of the invention is the attachment of a variety of pathology report labels, both with and without a diagram, photomicrograph, clinical photograph or superimposed overlay (discussed below) to the main pathology report 301. Hence, it is quite easy to file the report 300 provided.

The laboratory report system of the current invention also includes a clinical follow-up treatment recommendation system. The preferred mode of this system is through a "flagging system" that is marked on the anatomical diagram of the biopsy report 300. This system identifies on the anatomical diagram those specimens and diagnoses that require immediate attention and, using color coding of the flags, indicates the category and severity of the diagnosis, such as normal (benign), inflammatory, infectious, pre-malignant and malignant. Each of these diagnoses is identified by a specific color, as shown in the color code chart 323 in FIG. 3, and carries with it implications of a specific follow up that is required. However, even within a particular color, such as a malignancy diagnosis, there might be differences of follow-up. For example, for a biopsy of basal cell carcinomas with involved margins, the report would state "Red—Needs Follow-up Treatment", while for malignant melanoma invading the dermis the report might state "Red—Needs Immediate Follow-up Treatment—Physician To Call Patient And Call Physician Immediately With Findings". There would be an additional category for biopsies that require a work-up but are otherwise benign. These flags provide an immediate indication of the results of the biopsy for use by the clinician and the medical staff in order to more accurately complete the follow up and treatment. Diagram 322 on report 301 shows a spot at the biopsy site and, using color key 323, identifies the diagnosis and the follow up required.

As another feature of the system of the present invention, biopsy reports 300 can be generated specifically by follow-up category with listings of specific patient names in order to further allow the staff to double check and ensure that each lesion has been appropriately treated and that each patient receives the recommended follow-up care and visits established. For example, some diagnoses may require only phone conversations with the patient, and the doctor will be able to follow up by telephone rather than during an office visit, thus saving time for the patient, doctor and staff. This flagging system is further assisted by color or shape coding, with malignant being in Red color, pre-malignant being in Pink color, inflammatory being Blue in color, Infectious being in Green and other benign entities being in Grey color. Clinicians may be able to change the color coding in the set-up module written in the controlling software, coding the report as desired to meet their specific needs or personal vision problems. The most common colors used would be as stated above, unless an additional category is required.

Also, for a biopsy requiring follow-up, duplicate forms if desired by the clinician are created specifically for the ancillary staff, in order to serve as an additional check on the system. The controlling software for the report- generating system of the present invention can also be directed by the clinician who may want higher ancillary staff to get all reports or only some reports, such as only reports showing infectious, infectious and Red-need follow-up, or Red-periodic follow-up diagnoses. Furthermore, the controlling software for the report generating system of the present invention allows the clinician to specify what reports are to be classified into each of these categories, since there may be some difference among clinicians as to which diagnoses fit into each category. The control system, therefore, allows clinicians to be very specific and to have a computerized report generating system which allows them to double-check everything they do, with their own individual input determining how they want the follow-ups to be handled, treated and appropriately further followed-up.

The follow-up flagging or coding system provided by the reporting system of the present invention is applicable to all clinical specialties and can be adapted for each specialty by using different wording. Thus, the follow-up system can be modified to be made specific to the clinician's needs. Typical follow-up flags and codes are as follows: (1) "General—No Follow-up": This means that the patient's underlying condition is such that the patient need not be examined again for some time. Obviously, however, the doctor must be informed by the patient of any new problems. (2) "May or May Not Need Treatment": In this situation, clinical follow up requirements must be specified by the clinician regarding possible removal, excision and further treatment of the condition. The patient often must be seen in follow-up in order for the clinician to make the decision regarding treatment. An example of this category is situation in which a physician must decide whether a mole has been clinically completely removed. This is because pathologists often write with regard to "milder" pre-malignant conditions a note stating, "If there is any aspect of the lesion remaining clinically, please excise, otherwise it can be followed." However, this determination can only be made in person, and a clinician cannot rely on the opinion of the patient. (3) "Needs Work-up" or "May Need Work-up": Such a case exists if it is unclear whether there is an underlying or systemic process. Discussion between the patient/physician may be required regarding the biopsy, which may reveal a systemic disease, therefore requiring further testing, such as blood work or other tests. The patient may also be seen in a conference setting between the patient and physician. Diagnostic conditions might include discord lupus erythematosus, xanthoma, xanthelasma, some cases of alopecia and other localized diseases that may have a systemic component. (4) "Needs close follow-up": This flag means that the patient must have a periodic clinician follow-up visit unless the situation changes, and the patient must keep the physician abreast of any changes in his/her condition. Other complicating conditions might include a per-leukemic, pre-lymphomas or evolving mycosis fungoides, or any similar situation, in which one must closely monitor the patient's situation. (5) "Red Periodic Follow-up": This code is indicative of a pre-skin cancer such as dysplastic nevus, congenital nevus, actinic keratosis, cutaneous horn, etc., which are generally examined on three-month to one-year intervals. The system could automatically generate a letter to the patient regarding the follow up visit and sent based upon any of these follow-up flags/codes at the recommended return interval. (6) "Red-Needs treatment":

Immediate treatment is required, such as in cases of severe disease process, which need to be monitored closely. This code is usually indicative of a type cancer. Other codes include (7) "General-Needs Treatment" and (8) "Infectious", which also require follow-up. New codes are created or lumped together on a specialty need as well as to personalize for each physician.

The notation of the biopsy site on the anatomical diagram of the current invention can function in several ways based upon the clinician's preference. One way is that form 300 is provided with an exact copy of the drawing of the body part that the clinician completed on one of the many anatomical templates that are provided as part of the typical pathology requisition form such as in FIG. 8 showing the different body parts. FIG. 4 depicts images of the face 30, arms 32, legs 34, trunk 36, groin 38, scalp 39, ears 40, etc. and are specific to the multiple areas of the body where a clinician can obtain a skin specimen. These graphics are completed by the clinician and/or staff when completing the biopsy requisition and are labeled with letters, such as A, B, C or D, at the location where each biopsy is taken. The results of the pathology report are then printed onto the main pathology report 301 as well as onto the customized labels 304, either as text or as a diagram. Pathology labels 304 may then be peeled off bottom portion 302 of sheet 300 and adhered either into the biopsy book (shown in FIG. 5), on the patient's chart (shown in FIG. 6), or into patient's summary report (shown in FIG. 7) in front of the chart or other locations that would aid in treating patients. All these charting pathology labels, with and without a color-coded and shape coded diagram, photomicrograph or clinical photograph facilitate simple transmission of data and less risk of error with minimal work. The number, size shape and locations of labels 304 will depend on the physician/hospital standards as well as special studies or clinics requiring the information.

This diagram allows the clinician to show the exact site of the biopsy form the biopsy date. The label can be demarcated in color to match the follow-up color coded system, as shown in color chart 232 in FIG. 3 and in FIG. 11. Alternatively, this diagram can consist of quadrants, or sections of anatomic areas, shaded, and will also be demarcated in color to match the follow-up color coded system or by diagnosis. The report and labeling diagram system of the present invention allows or immediate observation, for clinical summary reports, for a summary of all reports, for one report using an overlay system or even the summary of previous reports on the same site on the report.

The pathology report diagram 322 will also be color-coded so that the flags on the biopsy report are preferably printed in the same color as the follow-up report flagging system. For example, an "A" (or a dot, or an "X", or whatever indication is used) which is a skin cancer would come out as a red "A"; a "B" that was a verruca may come out in a infectious color green; a "C" which is an actinic keratosis may come out in pink; and a "D" which is a benign nevus would come out in black. These colors match the colors that will be used in printing out the labels as well as on the pathology report. This color-coding allows for easy visualization and for identification of the disease process at a glance. Accordingly, the Red-Follow-up or Needing Treatment flag should be in red, Periodic Follow-up flag should be in pink, General Follow-up flag should be in black, and Infection should be in green for ease of interpretation. (Unfortunately, due to the nature of the black-and-white drawings submitted herewith, these color indications cannot be clearly shown in FIG. 3.

Even with all the reports hereinbefore provided, it often very difficult for a clinician to determine the exact location of the biopsy on the patient's body, especially if the patient has waited several weeks to return or if there are multiple biopsies, scars and/or rashes in the area. The present invention also provides for a novel system for indicating the exact location designated, called Specific Anatomic Mapping of the Biopsy Site. This procedure is extremely helpful in identifying the site of the biopsy, i.e. where the biopsy was obtained, and allows for the appropriate location of the biopsy site and the treatment of that biopsy site. Without specific site identification, many clinicians had been forced either to follow a small skin cancer until it grows larger or to treat the general area with a more diffuse treatment—such as cryosurgery—due to the fact that the exact location of the biopsy is not specifically identified.

Figure 9:
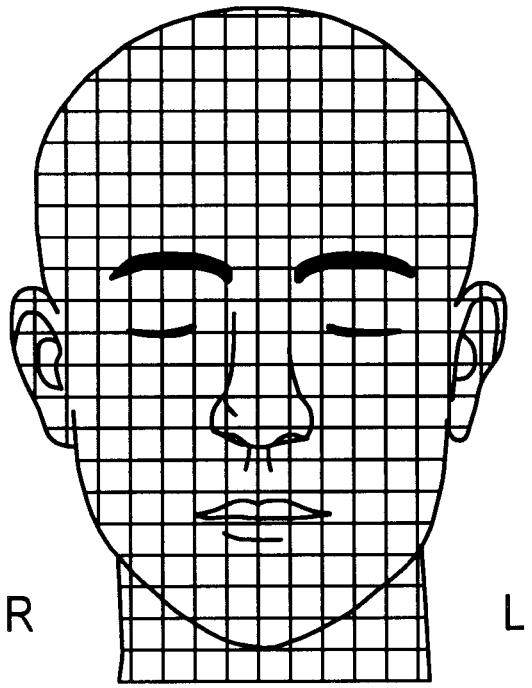
FIG. 9 shows a diagram picture of a human face divided into quadrants.
Figure 10:
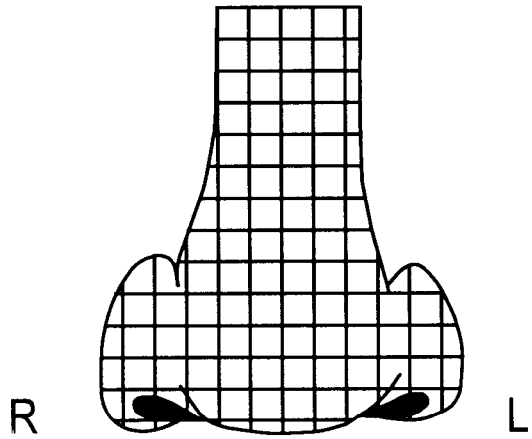
FIG. 10 shows a picture of a human nose divided into quadrants.

Alternatively, and more preferably, the diagram of the body part which is the subject of the biopsy can be presented in chart form divided into a grid having many small "quadrants". For example, as shown in FIG. 9, the face 30 depicted in FIG. 4 is divided up into may quadrants for easier identification of the precise site of the biopsy. In addition, specific parts of the face can be further subdivided into quadrants, for example the nose, as shown in FIG. 10, which is subdivided into many quadrants. In this embodiment of the diagram on report 300, only the quadrant in which an "X" is placed by the physician on the requisition form, denoting the location of the biopsy, is shaded on diagram 322 of biopsy report 300. For example, if the "X" were placed in quadrant no. F-10 denoting that quadrant as the biopsy location, only quadrant no. F-10 would be shaded on diagram 322 of biopsy report 300. This allows for clear visualization of the specific area, and also allows for better and clearer summary reports, as will be discussed below. The clinician will choose which of these two methods of diagramming will be presented on diagram 322 on report 301 and on printed labels 304 that are generated by the system of the invention. "Quadranting" is particularly helpful in certain specialties like gastroenterology and urology, in which the exact site is not reproducible and not known and, therefore, does not imply a specificity that is not reproducible or realistic.

The system of the present invention is capable of allowing the clinician to receive some of the reports printed one way and some of the reports printed other ways. Summary reports are perhaps generally better prepared using the multiple quadrant technique, since such a summary report, which can be in addition to the summary reports provided in the front of the chart, could be in the form of a diagram which summarizes all skin cancers on this person's body. If a patient has had two basal cells in one quadrant, the color in that quadrant would be a deeper shade of red, further specifying the fact that multiple basal cells have occurred in that quadrant. A note underneath the diagram can specify, for example, quadrant no. 34 with two basal cell carcinomas and their dates, or quadrant no. 34 having only one basal cell and quadrant no. 3 having had four basal cells, resulting in a much deeper area of red or with stripes denoting multiple biopsies of a malignancy in this area. Such a report could be generated with and without pre-cancers noted and with or without other benign conditions noted, as desired by the clinician.

The system of the invention is capable of producing reports on benign conditions diagnosed, pre-malignant conditions diagnosed and malignant conditions diagnosed as three separate reports. The system is also capable of producing a separate report that combines pre-malignant conditions, super-imposed by quadrants if desired or by overlay system by site. Such combined reports can also be super-imposed by letter or dot or symbol designation, according to a color key as illustrated in FIG. 11 and as shown in FIGS. 12A and 12B, as the clinician desires. The dot method using deeper colors or differing patterns for superimposed biopsy sites may be more preferable to use of letters, however, because one letter may be superimposed on another, causing confusion and making it difficult to visualize. Other clinicians may only be interested in the location of biopsied infectious diseases or by any category of disease, location or follow up. The advantage of the specific designation system is that it can be applied to in the exact location.

The colored or lettered biopsy flags 323 are generated onto body part diagram 322 of report 300 by digitizing the data provided in the diagram on the requisition form or by taking the biopsy site from the software in the computer. The biopsy site quadrant or exact location can be digitized into the computer either by scanning technology or through photographic technology using either a digital camera or video system or by any other known or acceptable method. Using any of these techniques, the diagram can be digitized and then imprinted onto the label 331, using either the "quadrant" or "exact" approach, as well as onto diagram 322 of main pathology report 301. It should be noted that scanning data or a picture yields a very close approximation but not a 100% identical image, as images may not be lined up exactly. Obviously, as computer technology advances and solves this problem, the system of the invention can be upgraded to minimize this problem. However, in the interim, precautions must presently be taken to minimize this problem using specialized software avoiding both scanning and photographic techniques. Alternatively staff can transpose the site into the computer exactly or by quadrant using the rows and columns or using pre-drawn diagrams of each site to match and confirm the exact site. Special line-up procedures and safeguards prevent placement of the markings in the wrong area.

As briefly discussed above, with reference to FIGS. 5–7, the locations of the different places where pathology report labels 330 and/or diagrams 331 are to be affixed are:

1. The clinical chart: The clinical chart is shown in FIG. 6 is the area in which the physician, nurses, and staff write their notes, any phone calls or any other messages that are dictated into a permanent record, which is part of the patient's permanent chart and which is obtainable by law when the patient changes physicians. The clinical chart is also the place where a notation of biopsies and their treatment is usually first made after a physician receives a pathology report. Most physicians use the clinical chart as their most important documentation area, and this is where all areas of treatment, as well as medications, are also noted. Until recently, the only way to note the results of a pathology report in the chart has been by writing it by hand. There had been no way to note the exact location of the biopsy except by using an independent drawing that was never directly matched to the diagram the clinician had given to the laboratory on the requisition form. Therefore, the diagram of the biopsy location that was drawn for the laboratory was not the exact same diagram that was inserted into the chart, if there was a diagram at all.

2. The second place where a pathology report label generated through the system of the invention will be placed is in the biopsy book, as shown in FIG. 5. The biopsy book is where the physician notes the date of service, the patient's name, the doctor performing the service, the site and clinical impression, the biopsy results, and perhaps other less crucial information, including insurance information, identification of medical assistants noting or assisting in the procedure. One important column in this book which some physicians include is "treatment required". As part of the labeling system of the present invention, the inventors have also devised a specialized, customized biopsy book that accommodates the labeling system so as to allow for easy set up of the biopsy book and for rapid and careful treatment, as it also accommodates the follow-up system employed elsewhere in the system. The follow-up wording as well as the color coding of the biopsy label allows the staff to warn the physician that a biopsy location still needs to be treated. This is in addition to those same warnings that will appear in the chart, which is what the physician usually sees. The biopsy book serves more as a back up and, once a lesion is treated, staff will then note that fact in the biopsy book also. Alternatively, all information could be included on the label such that no information has to be transcribed by hand into the biopsy book at the time of biopsy.

The biopsy book which is another feature of the system of the present invention has been formulated, as has the summary report, specifically to accommodate the pathology peel off label. Such a biopsy book has not previously been available to the clinician.

3. The third place where a pathology report label generated through the system of the invention can be placed is in the patient's summary chart, shown in FIG. 7. The summary chart is a summary of all biopsies and is placed in the front of the patient's main chart, allowing for rapid review of all the important diagnoses that have been biopsied to date, thereby saving a great deal of the doctor's time in reviewing the patient's chart and reducing risk of missing an important diagnosis. It also allows for less risk of missing an early recurrent cancer, since the clinician is better able to examine all specific areas in greater detail under higher magnification, as normally an entire body may not be observed under high magnification and only the specific suspicious areas, such as where the cancer has occurred, are observed. Extra attention is naturally given to previously involved sites.

Few doctors offices presently use a summary report of biopsies due to the tremendous amount of time required to write a summary by hand. However, given the availability of pathology report labels, either with or without a diagram, it is fast and easy to perform this task. Alternatively, monthly, quarterly or periodically as desired, a summary report of pathology labels can be created by various categories as determined by the clinician. A summary report can be created with or without an accompanying clinical diagram, photograph, or photomicrograph for pre-malignant or malignant cancers. These patient summary charts, if kept near the patient, serve as an immediate aid to better examination of patients. Alternatively, on a regular basis, for example quarterly or yearly, a list of labels can be generated summarizing only those malignant cancers, with or without pre-malignant, as desired by the clinician. Other types of follow-up can have a separate page or be included on the same summary sheet. For example, a summary report just for skin cancers with or without any diagnoses could be generated. Similarly, the labels for skin cancers could be printed in such a summary report with the occurrence of skin cancers in chronological order from top of the page to the bottom, or the system can print a summary report directly onto paper without printing labels, thereby saving a step, as well as time and effort. The summary report page can be configured so that the left side has a list of the biopsies and the right side has anatomic sites either drawn by hand, using the labeling system diagram or using the anatomic quadrant system referred to above for the "exact" site. The patient's summary chart is further sub-divided by diagnostic category and can be prepared for malignancies and pre-malignancies or any other category specified by the clinician. In the chart section, the diagram may be attached to the label, as shown in FIG. 2D, so that the two cannot be separated and thus cannot be confused. If so desired by the clinician or if separated patient information and both prevent risk of confusion.

4. The fourth place where a label with a diagram generated by the system of the present invention normally might be used is in the summary chart reports. A patient summary chart report can be an active summary chart, if one of the extra pathology report labels is used specifically for disease category malignancies or by flag follow up category, e.g., "General—No Follow-up". The clinician could set up the report either way or in multiple other ways.

Figure 13:
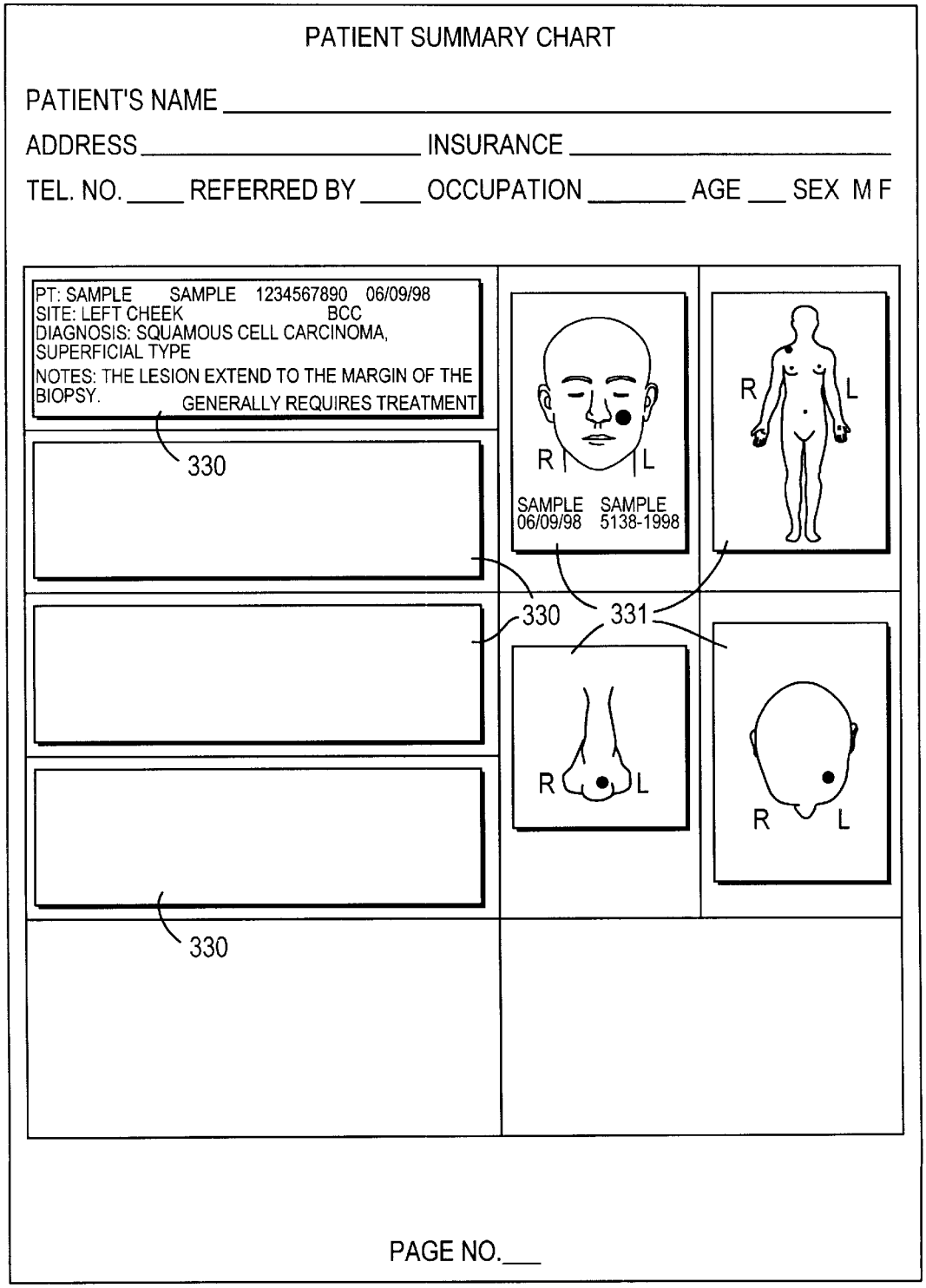
FIG. 13 shows a summary chart report showing a preferred use of the summary report labels.
Figure 14:
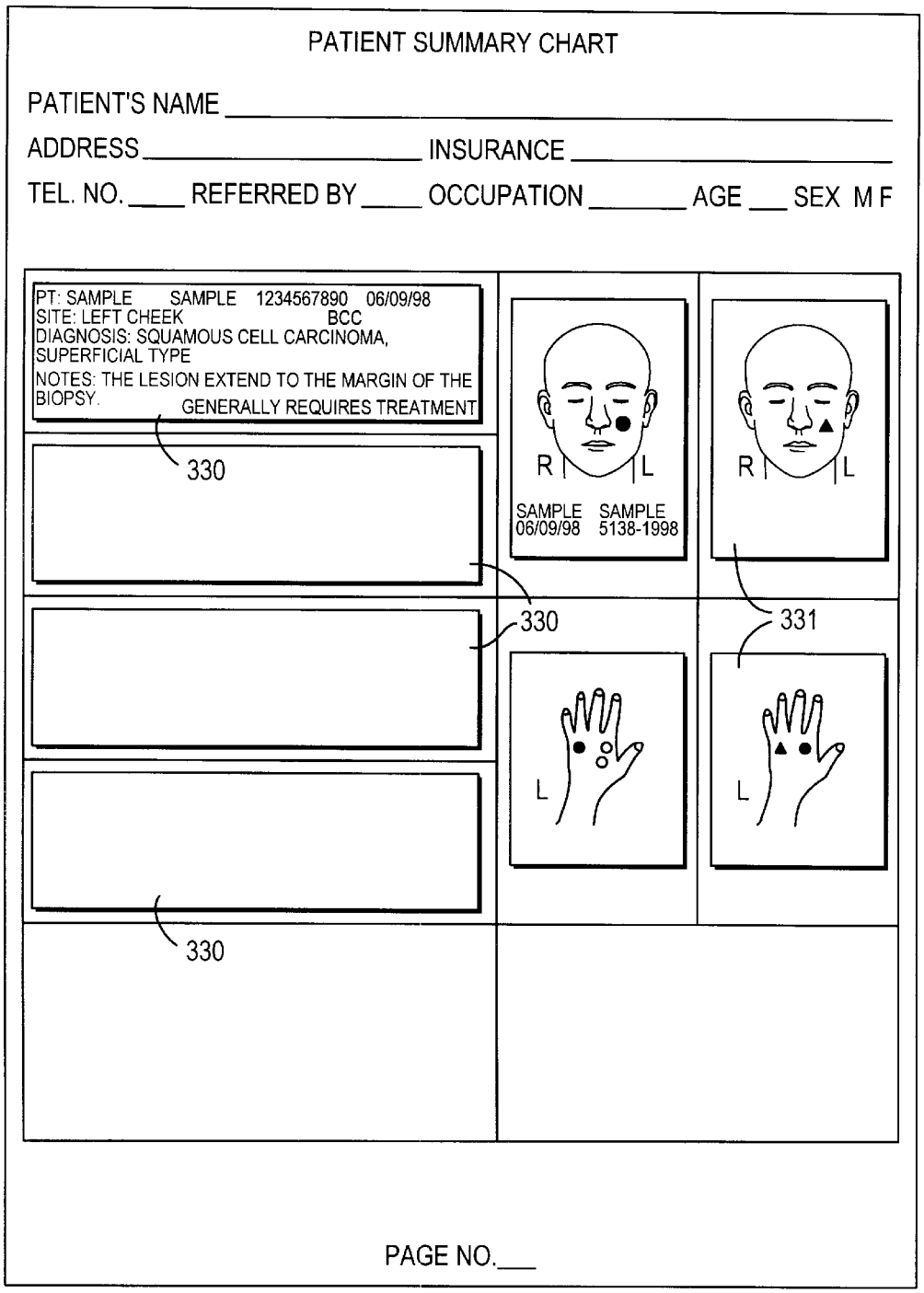
FIG. 14 shows a summary report chart showing another way of using the summary report labels.

The summary chart reports are one of the fastest ways to visualize a specific region or any specific problem. There are many alternative configurations and different ways to present the information. In one preferred arrangement, reports are presented on the same page by date order, in the same size as the summary using either the segmented or exact dot approach, with the diagnosis and dates noted elsewhere 330 on the page (see FIG. 13). Other optional configurations can incorporate the visualization of the summary report for that body part only or possibly even all body parts, also noted by time sequence (see FIG. 14). In one alternative presentation, one might have a summary of all affected sites. Alternatively, small replicas of the original diagrams using either exact or quadrant mode methods could be presented along the side of each summary or original biopsy report. Namely all clinical diagrams of FIG. 14 could be shown in color-coded format along the bottom row of man pathology report 301, as shown in FIG. 3, where the signature and overlay diagrams are presently noted. In another alternate arrangement, each diagram with a replica of previous diagnoses presented on bottom could be presented on a full page. All alternate arrangements can be produced either using the quadrant or exact technique diagram methods on pathology report 301 or on pathology labels 304.

The labeling system of the invention can also be effectively utilized for fungal cultures, blood tests and for other diagnostic tests. In one such embodiment, the fungal culture is written with a triplicate label and, after instituting the KOH, one label is put in each of the chart, the fungal culture book and the fungal culture bottle, until two weeks later when the results are noted. The technician then merely needs to note the final result on each of the three labels. This allows for less risk of lack of follow-up as well as more accurate, faster and less error-prone charting.

For blood work, perhaps only the abnormal results are placed on the label for entry into the chart. This label of abnormal or of a grouped test(e.g., cholesterol-related lab tests) could easily be placed on the chart from the page of all lab tests. The blood test results would look similar to next standard reports even designating also in the main report advanced blood test value and/or divided group tests. However, at the bottom or top or side of the sheet would be abnormal results or special lab grouping which could then be peeled off to the chart and tear off that section. Additional labels could be kept to match future blood vials, cultures or other purposes as described previously for pathology labeling system. Similarly, a lab summary sheet for the patient's chart and/or summary reports would be two other located n abnormal blood test, and any blood tests that are being followed in a patient. Any and all features of the pathology labeling system would also be incorporated to the blood test (a type of chemistry pathology) pathology labeling system.

In order to use the entire pathology labeling system of the invention appropriately, the physician is given various options during the set-up phase, i.e., as to which of the diagnoses would be matched up to which follow-up system specifically for themselves, what colors are to be used for the follow-up system, and various other choices to allow for specificity and flexibility of the system for that clinician. The system of the invention will save users countless hours and will save the physician countless time having to review a chart or perform an examination. It will also eliminate numerous errors in the treatment of improper locations as well as allow the physician to develop a better methodology for reviewing a patient chart and determining the follow-up for the specific cancers and other important areas to be treated and followed-up. The labeling system with a diagram gives the physician the flexibility to look for either the exact site or the important anatomic quadrants that has the greatest number of the category (e.g., "Red-Need Follow-up" treatment category) of diagnoses that would require additional follow-up. And, since the pathology label report is adjacent to the anatomic site diagram, the clinician can see exactly the area that the report is referring to (see FIG. 3). Further, on each label there is provision for a notation to designate which quadrant it relates to and which of the anatomical templates that were used; For example, "Q37" means quadrant 37 on that specific template. Therefore, when the system is used to summarize the diagrams, one on top of the other (overlay system) and five or six different quadrants of involved area (e.g. Red-category) appear, the clinician would be able to quickly determine to which biopsy each report was related. A number can be added (e.g., D7–11) to refer to a specific date of service and diagnosis to be listed elsewhere on the label and/or pathology report.

If two biopsy reports are related to the same area, that area would have a different demarcation (e.g., such as a deeper red or striping). Two of the biopsy reports would therefore be designated in the same quadrant in the same diagram, hence, accounting for its darker color, or striping. Another option would be a summary overlay of data by clinical follow up or for a specific diagnoses or desired (e.g., malignant melanoma or all types of BCC and SCC as a group) for that body part location.

In summary the overlay of scanned diagram can work as follows:

The requisition form (FIG 8.) has a diagram of the anatomical site. The client's office must indicate on one of these anatomical sites the exact biopsy site. This can be done by either placing a dot, a letter, or an "X" on the site of the biopsy. The diagram will be scanned, photographed or data entered into the computer. Depending on the diagnosis category (e.g., pre-malignant, malignant etc.), the color of the marking will be determined (see previous color-coded category descriptions) for specific follow-up flag coding.

Figure 15A:
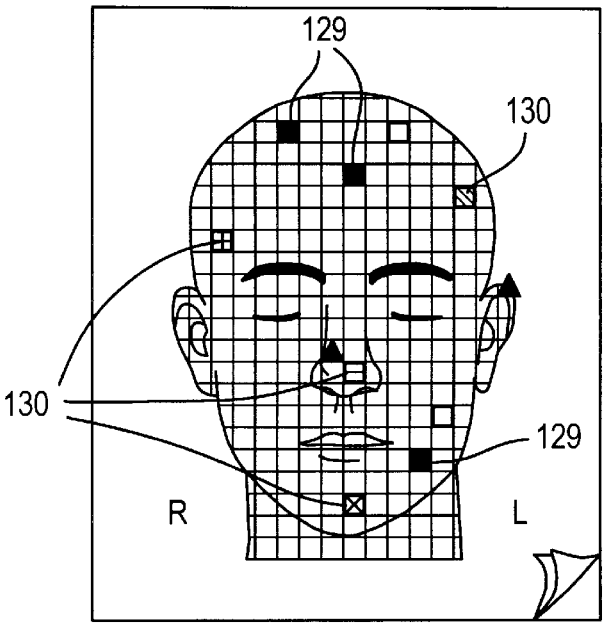
FIGS. 15A,B show overlay diagrams of a human face showing multiple biopsies taken at different sites at different times.

If there are multiple biopsies done over any period of time on the same site diagram, such as shown in FIG. 12B, all of the previously-entered diagrams are used for that site. At the client's request, the diagrams, diagnoses, diagnostic category or flag follow-up category for only certain specific time periods could be superimposed onto the labels and labeling system as illustrated in FIGS. 15A,B. The doctor may also be allowed to perform these functions themselves from their offices in an interactive mode. If more than one biopsy is located immediately near another, such as within the same quadrant in FIG. 15A, that quadrant will print out on the label in a darker shade of the same color 129 in order to indicate multiple malignancies in the same area. Other means could be used to indicate multiple malignancies in the same area, such a asterisks, stripes, checks, waved lines or other patterns 130.

This system can also be used for only one diagnosis, for all cancers or for only noncancers or combinations thereof, or by clinical impression.

Figure 15B:
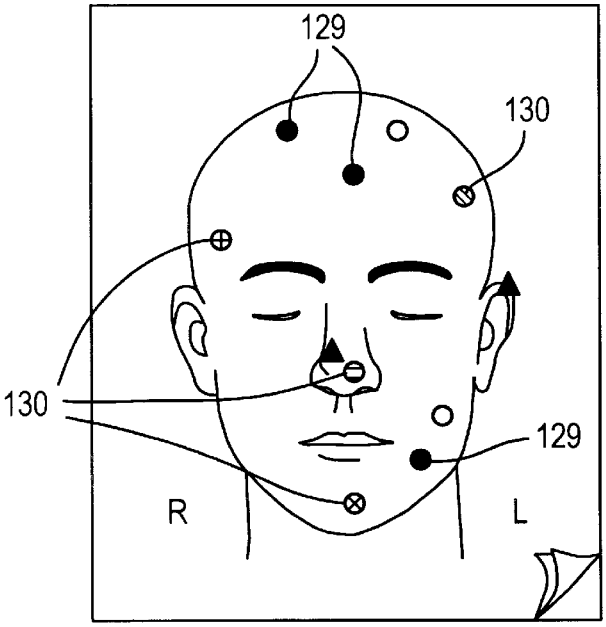

Alternatively to the quadrant system, an exact dot system can be used such that the exact spot of the biopsy site is noted in color coded categories, as shown in FIG. 15B. All other previous statements of overlay apply. In rare occurrences where two dots lie in the same area, there would be additional symbols, such as discussed above.

Another symbol will be used to indicate a pre-malignant lesion which is being monitored for change, to indicate changes seen on continued examination at future dates. This can then be incorporated into all regular diagrams, summary reports or overlays at the clinician's preference. This clinical diagnostic tool, e.g., an open circle or triangle or other shape, as desired, in contrast to the same shape filled in, would easily be visualized and separated from previously-biopsied areas. These could have their own color or be made pink for pre-cancer.

This new method of following the clinical examination would allow the physician to clearly see the relationship between the biopsy site of that particular visit either by itself or as part of an overlay diagram, as shown in FIG. 15. This allows not only for more careful checking of areas with confirmed diagnoses of all pre-cancers and cancers (never previously done) but also of any and all lesions suspected by the physician of being cancerous, so that the areas also have maximal observation. This melding of the clinical reporting with the pathology reporting on one form is a major advance in the care of patients, particularly when used in the overlay mode. The system can be refined for open circles to mean a specific diagnostic category and diagnosis (e.g., actinic keratosis or pre-cancers) and an open triangle could mean verruca or viral, etc.

In addition, a system for determining whether certain lesions previously biopsied are worsening in condition over time is being developed. This is especially helpful in monitoring dyplastic nevi, wherein a rating of 1 to 10, such that 1 is least suspicious and 120 is most suspicious, can be developed. In this example, two dyplastic nevi lesions in the patient's left cheek would be biopsied, since they have changed the most since the patient's last visit. This clinical monitoring system can be alone within a computer for pathology labeling. Future enhancements will show the date when first detected, how much has changed in the rating systems and other features.

They can therefore have a "peel off label" score sheet of their diagnoses on a daily, weekly or monthly basis. Built into the program will be a study of the clinician's clinical impression vs. the actual results. This can also be used to compare one clinician against others in the practice's clinical impressions vs. actual biopsy results to keep score as to how often the clinician's first number of impression (e.g. $1^{st}$, $2^{nd}$, $3^{rd}$, the impression was accurate). This information can also be made available to an insurance company with the clinician's permission in order to show how good the doctor is in correctly diagnosing diseases.

Other parameters can also be measured. For example statistics could be generated to determine how often the clinician did not go deep enough in his initial biopsy probe, the percentage of inadequate margins, how often a clinician misses a specific cancer diagnosis, whether the clinician is more accurate in diagnosing people of certain ages, genders or races or diagnosing certain parts of the body than others, the site at which most clinician's give the wrong clinical impression, whether the size varies for the stated size, etc. One could easily compile a weighted or non-weighted statistical report based upon criteria felt to be more important clinically. In addition, overall evaluations of physicians based upon on the scorecard labeling system could be generated periodically in order to rate the physicians' proficiency.

The labeling system of the invention and clinical follow-up by disease process can function on a stand-alone PC system. Appropriate software could be created such that the requisition form has diagrams templated with and/or without quadrants, prints on special laser paper with specially configured print labels attached, and bears the necessary follow-up system. The physician can also be allowed to change the labeling system or categories in specific prearranged choice parameter to meet their specific patient needs, either on the PC or via remote connection, such as modem or internet.

This invention also contemplates the following:

1. A laboratory labeling system for generating diagram which specifically designates by exact site or quadrant method the location of the lesions. This will be performed on each case. In addition this can be used as an "overlay" system with superimposition of previous pathology diagram over designated time by site. This can be farther separated (interactively by the lab a clinician) by diagnosis, clinical impression, disease category. It can also be used as an overlay of all patients or a category of patients utilizing the same diagram and be subdivided by any category desired (e.g. category of disease, race, age sex etc.). The overlay system can work by either the "exact" dot system or by "quadrant" overlay as discussed. This overlay system can be put into our 3-D 3 dimensional diagnosis which are being developed, similarly, of course regular diagram labels can be put into the 3D diagram. The 3D diagram would then be incorporated also on the requisition forms.

2. A laboratory labeling system for generating pathology reports which generates a clinical diagram supplied by the clinician to be added for documentation in the chart or other location.

3. A laboratory labeling system for generating pathology reports with labels to be customized by the client for other uses like labels with patients name for blood work, fungal culture other uses contemplated include labels for letter for patient (i.e. patients home address) label for referring doctor (I.e. referring doctor address) label for patient requiring follow up (i.e. patient name and all pertinent phone numbers, with diagram comment and required follow up). Labels for comic release e.g. fanny fare, for children, teddy bear, I got through the biopsy: tracking labels for the outside of the chart for:

1. To denote disease category of patient.
2. Insurance company a payment problem.
3. Allergic to - - - .
4. Special needs, assistance.
5. Special medication.
6. Does not hear.

Special information is dated so as the patients health changed, these could be updated.

4. A laboratory labeling system for generating pathology reports which offer the clinical to attach on one label the diagram and/or photomicrograph and/or clinical photograph to the label of the results of the pathology report.

5. A laboratory labeling system for generating pathology reports which allows for summary reports on label by categories chosen by the clinician in a chart format (e.g. skin cancer, or face, head neck over the last 20 years).

6. A laboratory labeling system for generating pathology reports of abnormal results only as in a blood test listing or labeling only the abnormal results. Also could have separate label for disease category e.g. cholesterol finding. This could have several labels including all blood tests results for cholesterol, only abnormal cholesterol results, results for normal only all to be placed in the chart or summary report sheets or other tables. Similarly their can have an overlay in chart, diagram, or other format of all previous abnormal or normal finding to be placed on label for chart which could be based on clinician performance.

7. A laboratory labeling system for generating pathology reports which is to be used by the clinician, multispecialty, etc. to perform basic science/ clinical studies which require the information of the pathology report. (e.g. chart, diagram etc.) comparing their doctor or all doctors in data base patients or a specific region of the country. For example, the information could include the number of skin cancers on the ear by age and region of the country. Or related to eating a food country or the number of skin conditions that result from eating a particular food (data to be supplied by clinician) and a specific pathology diagram. This can be followed over time by the labeling system or summary sheet.

Figure 16:
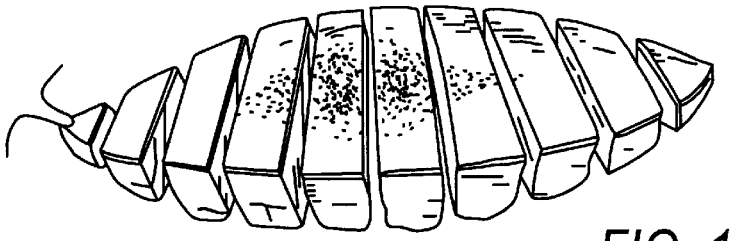
FIG. 16 shows an example of a specimen grossing diagram that may be placed on a report label.

8. A labeling system for pathology reports wherein the method of grossing the specimen in an excision can be placed on a label of the labeling system as part of the pathology report. Excision, also known as breadloafing, is a common manipulation of tissue for examination and can be manipulated onto a pathology report or onto the report labels, as shown in FIG. 16. Breadloafing can have evenly spaced excisions or could have excisions that are weighted according to the area of pathology.

9. A labeling system for pathology reports in which the clinician can decide in a interactive mode with the laboratory pathology labeling system software and/or administrator to change aspects of the labeling system to suit their specific needs (e.g. size of report, color, fonts, clinical information including the addition of information and data, demographics) of information to be included on the labeling system.

It will thus be seen that the objects set forth above, among those made apparent from the preceding description, are efficiently attained and, since certain changes may be made in the constructions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A laboratory report labeling system, comprising:

a sheet having first and second portions, said first and second portions being separable from each other by a tear line;

said first portion of said sheet being formed from non-adhesive material and bearing medical laboratory results information such that said first portion is in the form of a laboratory test report;

said second portion of said sheet being formed with adhesive material and being separable from said first portion along said tear line;

at least one label formed from said second portion, said at least one label bearing at least a portion of said information present on said first portion and being adherable to a medical document as an additional laboratory test report; and a visible means on at least one of said at least one label for identification of specific characteristics of a laboratory result or of a laboratory result at a anatomic site;

whereby each of said at least one label formed from said second portion can be separated one at a time from said second portion and adhered to a medical document as an additional report, such that, after all of said at least one labels are separated from said second portion, said first portion remains in the form of a standard-paper laboratory test report.

2. The laboratory report labeling system according to claim 1 further comprising a medical report chart having blank spaces sizably adapted for receipt of at least one of said at least one label formed from said second portion of said sheet.

3. The laboratory report labeling system according to claim 1 further comprising a specimen tracking book for maintaining a record of a specific patient's laboratory results and having blank spaces sizably adapted for receipt of at least one of said at least one label formed from said second portion of said sheet.

4. The laboratory report labeling system according to claim 1 wherein said at least one of said at least one label is transparent, such that said one of said at least one label may be separated from said second portion of said sheet and placed upon another of said at least one label such that the information on both of said labels is visible and shows superimposition of said visible means for identification of specific characteristics of the laboratory result but at different points in time, or of the laboratory result at the anatomic site but at different points in time, thereby showing a historical summary of information and data of the same laboratory result at different points in time.

5. The laboratory report labeling system according to claim 1, wherein said visible means comprises a color-coded marking to reflect the nature or severity of the laboratory results.

6. The laboratory report labeling system according to claim 1, wherein said visible means comprises at least one shaped symbol to reflect the nature or severity of the laboratory result.

7. The laboratory report labeling system according to claim 1, wherein said visible means comprises at least one of flags, warnings or notices to indicate recommendations for follow-up treatment of a diagnosis or laboratory result.

8. The laboratory report labeling system according to claim 1, wherein said visible means comprises at least one image depicting said anatomic site.

9. The laboratory report labeling system according to claim 1 wherein said at least one label is shaped to according to the shape of said anatomic site.

10. The laboratory report labeling system according to claim 1 wherein said at least one label may be customized in shape.

11. The laboratory report labeling system according to claim 1 wherein said at least one label has three dimensional characteristics.

12. The laboratory report labeling system according to claim 1 wherein at least two of said at least one label are separable from each other by a tear line such that said at least two of said at least one label may be used alternatively as one label or as at least two separate labels.

13. The laboratory report labeling system according to claim 1 wherein said second portion further comprises at least one transverse tear line separating said second portion into at least two sections such that at least one label is formed on each of said sections, whereby, after said at least one label is separated from a first of said at least two sections, a first section can be separated from the remaining of said at least two sections of said second portion and from said first portion.

14. The laboratory report labeling system according to claim 5, wherein said color-coded marking has a different shade of lightness or darkness depending on the nature or severity of the laboratory result.

15. The laboratory report labeling system according to claim 5, wherein said color-coded marking has a different shade of lightness or darkness depending on the number of the same or similar laboratory results that are located at said anatomic site.

16. The laboratory report labeling system according to claim 8, wherein said image depicts said anatomic site in at least two different points in time.

17. The laboratory report labeling system according to claim 8 wherein at least one of said at least one label is transparent, such that said one of said at least one label may be separated from said bottom portion of said sheet and placed upon another of said at least one label such that the information and data present on each of said labels is visible and shows superimposition of said visible means for identification of specific characteristics of the laboratory result but at different points in time, or of the laboratory result at the anatomic site but at different points in time, thereby showing a historical summary of information and data of the same laboratory result at different points in time.

18. The laboratory report labeling system according to claim 8, wherein said visible means further comprises a grid superimposed on said image of said anatomic site for precise identification of a specific position on said anatomic site.

19. The laboratory report labeling system according to claim 8, wherein said image depicting said anatomic site comprises a photograph of a specimen taken from said anatomic site.

20. The laboratory report labeling system according to claim 8, wherein said image depicting said anatomic site comprises a photomicrograph of a specimen taken from said anatomic site.

21. The laboratory report labeling system according to claim 8, wherein said image depicting said anatomic site comprises a sectional diagram of a specimen taken from said anatomic site.

22. The laboratory report labeling system according to claim 8 wherein said at least one label is shaped to according to the shape of said anatomic site.

23. The laboratory report labeling system according to claim 11 wherein said three dimensional characteristics comprise texture indicative of the nature of the information or data borne by said at least one label or of the nature or severity of the laboratory result at said anatomical site.

24. A system for reporting laboratory results, comprising:

a laboratory results charting means;

a laboratory report sheet having first and second portions that separable from each other by a tear line;

said first portion of said sheet being formed from non-adhesive material and bearing medical laboratory results information;

said second portion of said sheet being separable from said first portion along said tear line and bearing at least a portion of the information on said first portion;

at least one label bearing adhesive material formed in at least part of said second portion and adapted for removal from said second portion and for adherence to said laboratory results charting means;

an anatomic site locating grid on said sheet for identifying the anatomic site at which said information is reported;

whereby each of said at least one label formed from said second portion can be removed from said second portion and adhered to said laboratory results charting means, such that, after said at least one label is removed from said second portion, said second portion may be separated from said first portion such that said first portion remains in the form of a standard-paper main laboratory report sheet and said laboratory results charting means has been at least partially completed by adherence of said at least one label thereto.

25. The system for reporting laboratory results according to claim 24 wherein said laboratory results charting means comprises a summary report chart having blank spaces sizably adapted for receipt of at least one of said at least one label formed in said second portion of said sheet.

26. The system for reporting laboratory results according to claim 24 wherein said laboratory results charting means comprises a specimen tracking book for maintaining a record of a specific patient's laboratory results and having blank spaces sizably adapted for receipt of at least one of said at least one label formed in said second portion of said sheet.

27. The system for reporting laboratory results according to claim 24 wherein said at least one label is transparent and contains visible means for identification of specific characteristics of a laboratory result on said anatomic site locating grid, whereby said at least one label may be removed from said bottom portion of said sheet and placed upon another of said at least one label such that the information and data present on each of said labels is visible and shows superimposition of said visible means for identification of specific characteristics at the same anatomic site but at different points in time, thereby showing a historical summary of information and data of the anatomic site at different points in time.

28. The system for reporting laboratory results according to claim 24 wherein said at least one label is shaped to according to the shape of a specific anatomic site.

29. The system for reporting laboratory results according to claim 24 wherein said at least one label further comprises an image depicting said anatomic site, and said anatomic site locating grid is shown on said image for precise identification of the position on said anatomic site of said laboratory results.

30. The system for reporting laboratory results according to claim 24 further comprising a color-coded marking on said anatomic site locating grid for identification of characteristics of said laboratory results.

31. The system for reporting laboratory results according to claim 24 further comprising a shape-coded marking on said anatomic site locating grid for identification of characteristics of said laboratory results or to reflect the nature or severity of said laboratory results.

32. The system for reporting laboratory results according to claim 30 wherein said color-coded marking has a different shade of lightness or darkness depending on the nature or severity of said laboratory results.

33. The system for reporting laboratory results according to claim 30 wherein said color-coded marking has a different shade of lightness or darkness depending on the number of the same or similar laboratory results that are located at said anatomic site.

34. The system for reporting laboratory results according to claim 30 wherein said at least one label is transparent and further comprises an image depicting said anatomic site, and said anatomic site locating grid is shown on said image for precise identification of the specific position on said anatomic site of said laboratory results, such that said at least one label may be removed from said second portion of said sheet and placed upon a previously generated image depicting said anatomic site at a previous point in time and bearing an anatomic site locating grid, such that the anatomic site locating grid present on each of said images is visible and shows superimposition of the color-coded marking of the laboratory results of said anatomic site but at different points in time.

35. The system for reporting laboratory results according to claim 31 wherein said at least one label is transparent and further comprises an image depicting said anatomic site, and said anatomical site locating grid is shown on said image for precise identification of the position on said anatomic site of said laboratory results, such that said at least one label may removed from said second portion of said sheet and placed upon a previously generated image depicting said anatomic site at a previous point in time and bearing an anatomic site locating grid, such that the anatomic site locating grid present on each of said images is visible and shows superimposition of the shape-coded marking of the laboratory results of said anatomic site but at different points in time.

36. A method for reporting laboratory results, comprising:

providing a laboratory result request form having visible means thereon for indicating medical information or data representing the type or anatomic site of a desired laboratory test;

indicating on said visible means medical information or data representing the type or anatomic site of a desired laboratory test;

performing said desired laboratory test and deriving results therefrom;

providing a laboratory report form having first and second portions of a sheet being separable from each other by a tear line, said first portion of said sheet being formed from non-adhesive material and bearing medical laboratory results information of said laboratory test, and said second portion of said sheet bearing at least a portion of the medical information or data present on said first portion and being separable from said first portion along said tear line;

providing at least one label bearing adhesive material formed in at least part of said second portion of said sheet, which can be removed from the remainder of said portion and adhered to a laboratory results charting means, said at least one label having thereon medical information or data representing the results or anatomic site of said laboratory test; and providing an anatomic site locating grid on said sheet for identifying the point on said anatomic site at which said laboratory results are reported;

whereby each of said at least one label formed from said second portion can be removed one at a time from said second portion and adhered to said laboratory results charting means, such that, after all of said at least one label are removed from said second portion, said second portion may be separated from said first portion such that said first portion remains in the form of a standard-paper main laboratory report sheet and said laboratory results charting means has been at least partially completed by adherence of said at least one label thereto.

37. The method for reporting laboratory results according to claim 36, wherein said laboratory results charting means comprises a summary report chart having spaces sizably adapted for receipt of at least one of said at least one label, said method further comprising the step of removing said at least one label from said second portion and adhering said at least one label to said summary report chart.

38. The method for reporting laboratory results according to claim 36, wherein said laboratory results charting means comprises a specimen tracking book for maintaining a record of a specific patient's laboratory results and having blank spaces sizably adapted for receipt of at least one of said at least one label, said method further comprising the step of removing said at least one label from said second portion and adhering said at least one label to said specimen tracking book.

39. The method for reporting laboratory results according to claim 36, wherein said step of providing at least one label comprises providing at least one of said at least one label that is transparent, said method further comprising the step of adhering said transparent one of said at least one label upon another of said at least one label, such that the information or data representing said results or anatomic site of said laboratory test present on each of said labels is visible and shows superimposition of said results of said laboratory tests at the same anatomic site but at different points in time, thereby showing a historical summary of laboratory test results at said anatomic site at different points in time.

40. The method for reporting laboratory results according to claim 36, wherein said step of providing at least one label comprises providing an image of an anatomic site and said anatomic site locating grid on said at least one label, said method further comprising the step of providing on said anatomic site locating grid a color-coded marking for identification of characteristics of said results of said laboratory test.

41. The method for reporting laboratory results according to claim 36, wherein said step of providing at least one label comprises providing an image of an anatomic site and said anatomic site locating grid on said at least one label, said method further comprising the step of providing on said anatomic site locating grid a shape-coded marking for identification of characteristics of said results of said laboratory test.

42. The method for reporting laboratory results according to claim 40, wherein said step of providing a color-coded marking further comprises providing on said anatomic site locating grid a color-coded marking in a different shade of lightness or darkness depending on the nature or severity of said characteristics of said results of said laboratory test.

43. The method for reporting laboratory results according to claim 40, wherein said step of providing a color-coded marking further comprises providing on said anatomic site locating grid a color-coded marking in a different shade of lightness or darkness depending on the number of the same or similar characteristics of said results of said laboratory test that are located at said same point on said anatomic site.

44. The method for reporting laboratory results according to claim 40, wherein said step of providing at least one label comprises providing at least one of said at least one label that is transparent, said method further comprising the step of adhering said transparent one of said at least one label upon another of said at least one label, such that said color-coded marking for identification of characteristics of said results of said laboratory test present on each of said labels is visible and shows superimposition of said results of said laboratory tests at the same anatomic site but at different points in time, thereby showing a historical summary of said characteristics of said results of said laboratory tests at said anatomic site at different points in time.

45. The method for reporting laboratory results according to claim 41, wherein said step of providing at least one label comprises providing at least one of said at least one label that is transparent, said method further comprising the step of adhering said transparent one of said at least one label upon another of said at least one label, such that said shape-coded marking for identification of characteristics of said results of said laboratory test present on each of said labels is visible and shows superimposition of said results of said laboratory tests at the same anatomic site but at different points in time, thereby showing a historical summary of said characteristics of said results of said laboratory tests at said anatomic site at different points in time.

* * * * *